US010401105B2

(12) United States Patent
Dowling et al.

(10) Patent No.: US 10,401,105 B2
(45) Date of Patent: Sep. 3, 2019

(54) MULTI-CALIBER MAGAZINE FOR A FIREARM AND A METHOD OF FORMING THE SAME

(71) Applicant: Sig Sauer, Inc., Newington, NH (US)

(72) Inventors: John J. Dowling, Rollinsford, NH (US); David B. Hopkins, Exeter, NH (US); John Wilson, East Waterboro, ME (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/868,099

(22) Filed: Jan. 11, 2018

(65) Prior Publication Data

US 2018/0202734 A1 Jul. 19, 2018

Related U.S. Application Data

(60) Provisional application No. 62/445,859, filed on Jan. 13, 2017.

(51) Int. Cl.
*F41A 9/65* (2006.01)
*F41A 9/71* (2006.01)

(52) U.S. Cl.
CPC ..... *F41A 9/71* (2013.01)

(58) Field of Classification Search
CPC ..... F41A 9/61; F41A 9/62; F41A 9/64; F41A 9/65; F41A 9/66; F41A 9/67; F41A 9/68; F41A 9/69; F41A 9/70; F41A 9/71
See application file for complete search history.

(56) References Cited

U.S. PATENT DOCUMENTS 1,306,972 A * 6/1919 Nelson ..... F41A 9/65 42/50
1,462,972 A * 7/1923 Lewis ..... F41A 9/69 42/50
2,434,269 A * 1/1948 Harvey ..... F41A 9/69 42/18
2,510,831 A * 6/1950 Patchett ..... F41A 9/69 42/50

(Continued)

OTHER PUBLICATIONS

Douglas Thompson, ".300 Blk Magpul Magazine Problems and Fixes!", published on Jan. 8, 2016, [retrieved online on May 16, 2018] from <URL: https://www.youtube.com/watch?v=5Szcyda7xs8>, 3 pages.

(Continued)

*Primary Examiner* — Derrick R Morgan
(74) *Attorney, Agent, or Firm* — Finch & Maloney PLLC

(57) ABSTRACT

A multi-caliber automatic rifle (AR) magazine is configured to alternately receive a first cartridge having a first caliber and a second cartridge having a first caliber. The multi-caliber AR magazine includes a first pair of ribs, a second pair of ribs, and a third pair of ribs such that the first pair of ribs and the second pair of ribs are configured to both support the body of the cartridge when loaded in the magazine. The second pair of ribs are indented toward a center of the multi-caliber AR magazine housing more than the first pair of ribs such that a distance between the second pair of ribs is less than a second distance between the first pair of ribs. The third pair of ribs can be rebated to form a dual-curved rib having a central convex portion connected between two concave portions.

23 Claims, 12 Drawing Sheets

(56) References Cited

U.S. PATENT DOCUMENTS

| | | | | | |
|---|---|---|---|---|---|
| 2,777,235 | A * | 1/1957 | Hopkins | F41A 9/69 | 42/50 |
| 3,039,221 | A * | 6/1962 | Musgrave | F41A 9/70 | 267/165 |
| 3,399,480 | A * | 9/1968 | Rowe, Jr. | F41A 9/69 | 42/50 |
| 3,619,929 | A * | 11/1971 | Fremont | F41A 9/69 | 42/50 |
| 3,726,038 | A * | 4/1973 | Bredbury | F41A 9/70 | 42/50 |
| 4,314,419 | A * | 2/1982 | Koon, Jr. | F41A 9/65 | 42/50 |
| 4,688,344 | A * | 8/1987 | Kim | F41A 9/67 | 42/50 |
| 4,776,122 | A * | 10/1988 | Dieringer | F41A 9/65 | 42/50 |
| 4,888,900 | A * | 12/1989 | Howard | F41A 9/70 | 42/50 |
| 5,956,878 | A * | 9/1999 | Yang | F41A 9/65 | 42/18 |
| 8,448,364 | B2 | 5/2013 | Davidson | | |
| 9,303,936 | B2 | 4/2016 | Toner | | |
| 9,347,721 | B2 * | 5/2016 | Larson, Jr. | F41A 9/70 | |
| 9,534,876 | B2 * | 1/2017 | Silvers | F42B 5/28 | |
| 2001/0037596 | A1 | 11/2001 | Salvitti | | |
| 2006/0242877 | A1 * | 11/2006 | Clifton, Jr. | F41A 9/63 | 42/49.01 |
| 2010/0101132 | A1 * | 4/2010 | Jacobson | F41A 9/65 | 42/50 |
| 2012/0124879 | A1 * | 5/2012 | Larue | F41A 9/70 | 42/50 |
| 2012/0131831 | A1 * | 5/2012 | Sullivan | F41A 9/69 | 42/50 |
| 2013/0081315 | A1 * | 4/2013 | Thordsen | F41A 9/61 | 42/49.01 |
| 2014/0068986 | A1 * | 3/2014 | Pietrzyk | F41A 9/17 | 42/6 |
| 2014/0150315 | A1 * | 6/2014 | Russell | F41A 9/65 | 42/50 |
| 2014/0373415 | A1 * | 12/2014 | Faifer | F41A 9/65 | 42/49.01 |
| 2015/0082678 | A1 * | 3/2015 | Jacobson | F41A 17/38 | 42/8 |
| 2015/0192377 | A1 * | 7/2015 | Larson, Jr. | F41A 9/70 | 42/50 |
| 2015/0226531 | A1 * | 8/2015 | Silvers | F42B 5/28 | 102/439 |
| 2015/0247691 | A1 * | 9/2015 | Solomon | F42B 39/02 | 42/87 |
| 2016/0025436 | A1 * | 1/2016 | Higley | F41A 9/65 | 42/49.01 |
| 2016/0282071 | A1 * | 9/2016 | Vilardi | F41A 9/65 | |
| 2016/0348992 | A1 * | 12/2016 | Tisone | F41A 9/59 | |
| 2017/0356708 | A1 * | 12/2017 | Michael | F41A 9/70 | |
| 2018/0180369 | A1 * | 6/2018 | Pappas | F41A 3/64 | |
| 2018/0202734 | A1 * | 7/2018 | Dowling | F41A 9/71 | |

OTHER PUBLICATIONS

"Lancer Systems—AR-15 L5AWM 300BLK Translucent Smoke Magazine 30RD", [retrieved online on May 16, 2018] from <URL: https://www.brownells.com/magazines/rifle-magazines/magazines/ar-15-l5awm-300blk-translucent-smoke-magazine-30rd-prod116416.aspx>, 1 page.

"PMAG 30 AR 300 B Gen M3, 300 BLK", published Mar. 23, 2018, [retrieved online on May 16, 2018] from <URL: https://www.magpul.com/products/pmag-30-ar-300-b-gen-m3-300-blk>, 5 pages.

"Instruction Manual for Ruger American Pistol Pro Model", Sturm, Ruger & Co., Inc. (2016).

"Instruction Manual for Ruger American Pistol, Standard Model", Sturm, Ruger & Co., Inc. (2016).

* cited by examiner

MULTI-CALIBER MAGAZINE FOR A FIREARM AND A METHOD OF FORMING THE SAME

RELATED APPLICATIONS

This application claims benefit of U.S. Provisional Application No. 62/445,859, titled MULTI-CALIBER MAGAZINE FOR A FIREARM AND A METHOD OF FORMING THE SAME and filed Jan. 13, 2017.

FIELD OF THE DISCLOSURE

The present disclosure relates to magazines for automatic rifles and other housings configured to support cartridges for an automatic rifle.

BACKGROUND

An automatic rifle (AR) is fed by a magazine so that the AR can fire repeatedly, for as long as the trigger is held down or until the magazine is exhausted. The magazine stores ammunition for the AR and feeds the ammunition into the AR. In some cases, the magazine is detachable or otherwise removable so that it can be attached and then removed and in some cases the magazine is integral with the AR. The magazine is responsible for positioning the cartridges appropriately with respect to the chamber of the rifle so that they can be loaded directly into the chamber by action of the firearm.

SUMMARY

The multi-caliber magazine and method of forming the same described in the present disclosure provide a magazine that is configured to receive cartridges having differing calibers.

Accordingly, pursuant to one aspect of the invention, there is contemplated a multi-caliber magazine for a firearm configured to support a plurality of cartridges, the multi-caliber magazine comprising a housing having a front, a rear, a first side surface extending vertically between the front and the rear, and a second side surface extending vertically between the front and the rear, a first pair of indented opposed ribs including a first rib extending vertically along a first side surface of a housing, and a second rib extending vertically along a second side surface of the housing, the first pair of ribs positioned proximate the rear of the housing, and a second pair of indented opposed ribs including a third rib extending vertically along the first side surface of the housing, and a fourth rib extending vertically along the second side surface of the housing, wherein a first distance between the third rib and the fourth rib is less than a second distance between the first rib and the second rib. The magazine can further include a third pair of indented opposed ribs including a fifth rib extending vertically along the first side surface of the housing, and a sixth rib extending vertically along the second side surface of the housing, wherein the third pair of ribs is positioned proximate the front of the housing, and wherein the second pair of ribs are positioned between the first pair of ribs and the third pair of ribs. In some cases, at least a portion of the fifth rib forms a dual-curved rib with a central convex portion connected between two concave portions, so that the fifth rib does not contact the plurality of cartridges as they pass from a bottom of the housing toward a top of the housing. In some cases, the portion of the fifth rib forms the dual-curved rib by indenting the third pair of ribs and then raising a center portion of the fifth rib to define the two concave portions and the central convex portion. In some cases, at least an upper portion of the fifth rib is not dual-curved so that the fifth rib extends inwardly and contacts a top-most cartridge of the plurality of cartridges. In some cases, the first rib and the third rib are positioned to simultaneously contact a case of at least some of the cartridges when the cartridges are loaded in the magazine. In some cases, a portion of the fifth rib and the sixth rib each form a creased surface. In some cases, the housing is configured to support both a first caliber cartridge and a second caliber cartridge, the first caliber different from the second caliber. In some cases, the housing is configured to functionally support both 300 Blackout cartridges and 5.56 NATO cartridges. In some cases, the housing is formed of a stamped sheet metal material. In some cases, the housing is formed of an injection-molded polymer. In some cases, one rib of the first pair of ribs and one rib of the second pair of ribs are constructed and arranged to simultaneously contact at least one of the plurality of cartridges when the magazine is full.

According to the present disclosure, a method of forming a multi-caliber automatic rifle (AR) magazine from a housing having a front, a rear, a first side surface extending vertically between the front and the rear, and a second side surface extending vertically between the front and the rear, the multi-caliber AR magazine configured to support a plurality of cartridges is provided. The method includes forming a first pair of ribs on the housing, the first pair of ribs including a first rib extending vertically along the first side surface of the housing and a second rib extending vertically along the second side surface of the housing, the first pair of ribs positioned proximate the rear of the housing, and forming a second pair of ribs on the housing, the second pair of ribs including a third rib extending vertically along the first side surface of the housing and a fourth rib extending vertically along the second side surface of the housing, the second pair of ribs being indented toward a center of the housing more than the first pair of ribs. In some cases, the method further includes forming a third pair of ribs on the housing, the third pair of ribs including a fifth rib extending vertically along the first side surface of the housing and a sixth rib extending vertically along the second side surface of the housing, wherein the third pair of ribs are formed proximate the front of the housing, wherein the second pair of ribs are formed between the first pair of ribs and the third pair of ribs. In some cases, the housing is a sheet metal material, and wherein forming the first pair of ribs, forming the second pair of ribs, and forming the third pair of ribs is performed by stamping the sheet metal material of the housing. In some cases, forming the first pair of ribs, forming the second pair of ribs, and forming the third pair of ribs is performed by injection-molding a polymer. In some cases, the method further comprises raising a central portion of the fifth rib and the sixth rib to each define a dual-curved rib with a central convex portion connected between two concave portions.

According to the present disclosure, a multi-caliber magazine for a firearm configured to support a plurality of cartridges is provided. The multi-caliber magazine includes a first pair of ribs including a first rib extending vertically along a first side surface of a housing, and a second rib extending vertically along a second side surface of the housing, the first pair of ribs positioned proximate a rear of the housing, a second pair of ribs including a third rib extending vertically along the first side surface of the housing, and a fourth rib extending vertically along the second side surface of the housing, and a third pair of ribs including a fifth rib extending vertically along the first side surface of the housing, and a sixth rib extending vertically along the second side surface of the housing, wherein the third pair of ribs are positioned proximate a front of the housing, wherein the second pair of ribs are positioned between the first pair of ribs and the third pair of ribs, wherein the fifth rib and the sixth rib each define a dual-curved rib with a central convex portion connected between two concave portions. In some cases, the lower portion of the third pair of ribs are rebated so that the third pair of ribs do not contact the plurality of cartridges as they pass from a bottom of the housing toward a top of the housing. In some cases, the lower portion of the third pair of ribs is rebated by indenting a center portion of each rib to form two curves. In some cases, at least an upper portion of the third pair of ribs are not rebated so that the third pair of ribs contact only a top-most cartridge of the plurality of cartridges. In some cases, the multi-caliber AR magazine is formed of a stamped sheet metal material or an injection-molded plastic material.

According to the present disclosure, a method of feeding cartridges to a firearm is provided. The method includes loading a magazine with a plurality of cartridges, placing the magazine into the magazine well of the firearm, and feeding the plurality of cartridges upwardly into a breech of the firearm while laterally supporting a casing of the cartridges with two indented ribs on an inside wall of the magazine, a first rib located proximate a head of the cartridge and a second rib proximate a projectile. In some cases, the method includes re-loading the magazine with a plurality of a different caliber cartridge and feeding the plurality of different caliber cartridges into the breech of the firearm.

Figure 1:
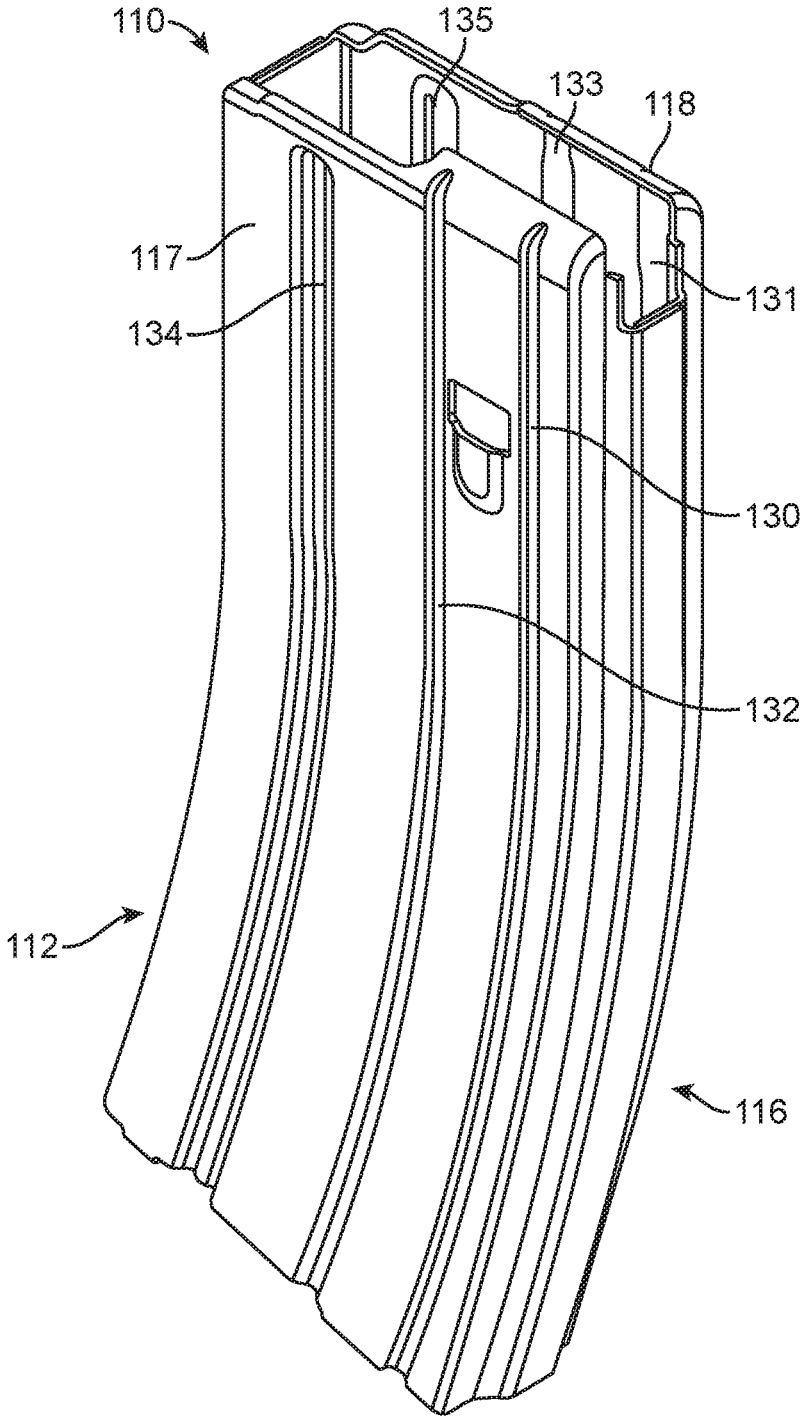
FIG. 1 is a perspective view of a multi-caliber automatic rifle (AR) magazine for supporting a plurality of cartridges for the AR, in accordance with an embodiment of the present disclosure.

These and other features of the present embodiments will be understood better by reading the following detailed description, taken together with the figures herein described. The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

In accordance with an example embodiment, a multi-caliber magazine for an automatic rifle (AR) or other firearm and a method of forming the same, are disclosed. The multi-caliber AR magazine is configured to support cartridges of different calibers by providing two contact points (or one continuous contact region) for the body of the cartridge along the inside surface of the multi-caliber AR magazine. In this manner, for example, the multi-caliber AR magazine is able to support both a 556 caliber (e.g., 556 NATO) and a 300 caliber (e.g., 300 Blackout) cartridge, or other caliber cartridges having common diameters that taper along the body portion of the cartridge and differing length, bullet caliber, or other differing features, by supporting the cartridges based on common features between the cartridges.

Numerous configurations and variations will be apparent in light of this disclosure. For example, the multi-caliber AR magazine can be made from stamped sheet metal, polymer, fiberglass, carbon fiber, or other appropriate material. Polymer magazines can be made using various molding techniques including injection molding, blow molding, vacuum molding or 3D printing.

FIG. 1 is a perspective view of a multi-caliber automatic rifle (AR) magazine for supporting a plurality of cartridges for the AR, in accordance with an embodiment of the present disclosure. The multi-caliber AR magazine is configured to be attached to an AR or other firearm for feeding cartridges into the AR for firing, in accordance with an embodiment. In some embodiments, the multi-caliber AR magazine may be integrated into the rifle as a unitary structure. It will be appreciated in light of the present disclosure that the magazine can be for any appropriate firearm configured to receive a magazine having multiple cartridges, such as an MCX rifle, a 516 tactical rifle, an M16 rifle, an AR-15 rifle, an M400 rifle, or their generic equivalents.

The multi-caliber AR magazine 110 defines a housing having a front 112, a rear 116, a first side 117, and a second side 118, in accordance with an embodiment. The first side 117 extends vertically between the front 112 and the rear 116. The second side surface 118 extends vertically between the front 112 and the rear 116 and is opposite the first side surface 117.

As illustrated the multi-caliber AR magazine 110 defines three pairs of indented projections, referred to herein as ribs in several embodiments, although any appropriate indented projection or controlling surface can be formed, as will be appreciated in light of the present disclosure. Although much of this disclosure discusses embodiments including three pairs of ribs, in other embodiments, some or all of the ribs can be eliminated or otherwise modified. For instance, the third pair of ribs can be eliminated and in some cases the first two pair of ribs can be combined into a single indent or one or more of the ribs can be replaced with an elongated inward projection. The AR magazine 110 includes three pairs of ribs, including a first pair of indented opposed ribs 130, 131 positioned proximate the rear 116 of the multi-caliber AR magazine 110, a second pair of indented opposed ribs 132, 133 and a third pair of indented opposed ribs 134, 135 positioned proximate the front 112 of the multi-caliber AR magazine 110. The second pair of ribs 132, 133 is positioned between the first pair of ribs 130, 131 and the third pair of ribs 134, 135. The first pair of ribs 130, 131 includes a first rib 130 extending vertically along the first side 117 of the housing, and a second rib 131 extending vertically along the second side 118 of the housing. The second pair of ribs 132, 133 includes a third rib 132 extending vertically along the first side 117 of the housing, and a fourth rib 133 extending vertically along the second side 118 of the housing. The third pair of ribs 134, 135 includes a fifth rib 134 extending vertically along a first side 117 of the housing and a sixth rib 135 extending vertically along the second side 118 of the housing.

Note that although three pairs of ribs are disclosed, in some embodiments the third pair of ribs may be omitted. In such an embodiment, the first pair of ribs and the second pair of ribs would still contact the body of the cartridge as it passes through the cartridge. However, there may be only be two pairs of ribs, and the third pair of ribs could be omitted. For manufacturing from sheet metal this could require a different production blank than existing caliber-specific magazine, as less sheet metal material would be used due to fewer deviations in the cross section of the magazine. One advantage to providing the third pair of ribs is that it allows for a magazine to be stamped from the same blank as a mil-spec magazine, by consuming the same amount of stock as the original ribs. However, if desirable to consume even less material, the third pair of ribs could be omitted and a different sheet metal blank can be used.

As will be described in greater detail below, the first pair of ribs 130, 131 and the second pair of ribs 132, 133 are configured to simultaneously contact the body portion of the cartridges supported in the magazine 110, such that cartridges of different calibers can be securely supported by a same magazine. It will be appreciated in light of the present disclosure that the second pair of ribs can be indented toward a center of the housing more than the first pair of ribs, such that a first distance between the third rib 132 and the fourth rib 133 (as measured within the housing between an innermost point of the third rib and an innermost point of the fourth rib) is less than a second distance between the first rib 130 and the second rib 131 (as measured within the housing between an innermost point of the first rib and an innermost point of the second rib).

Figure 2:
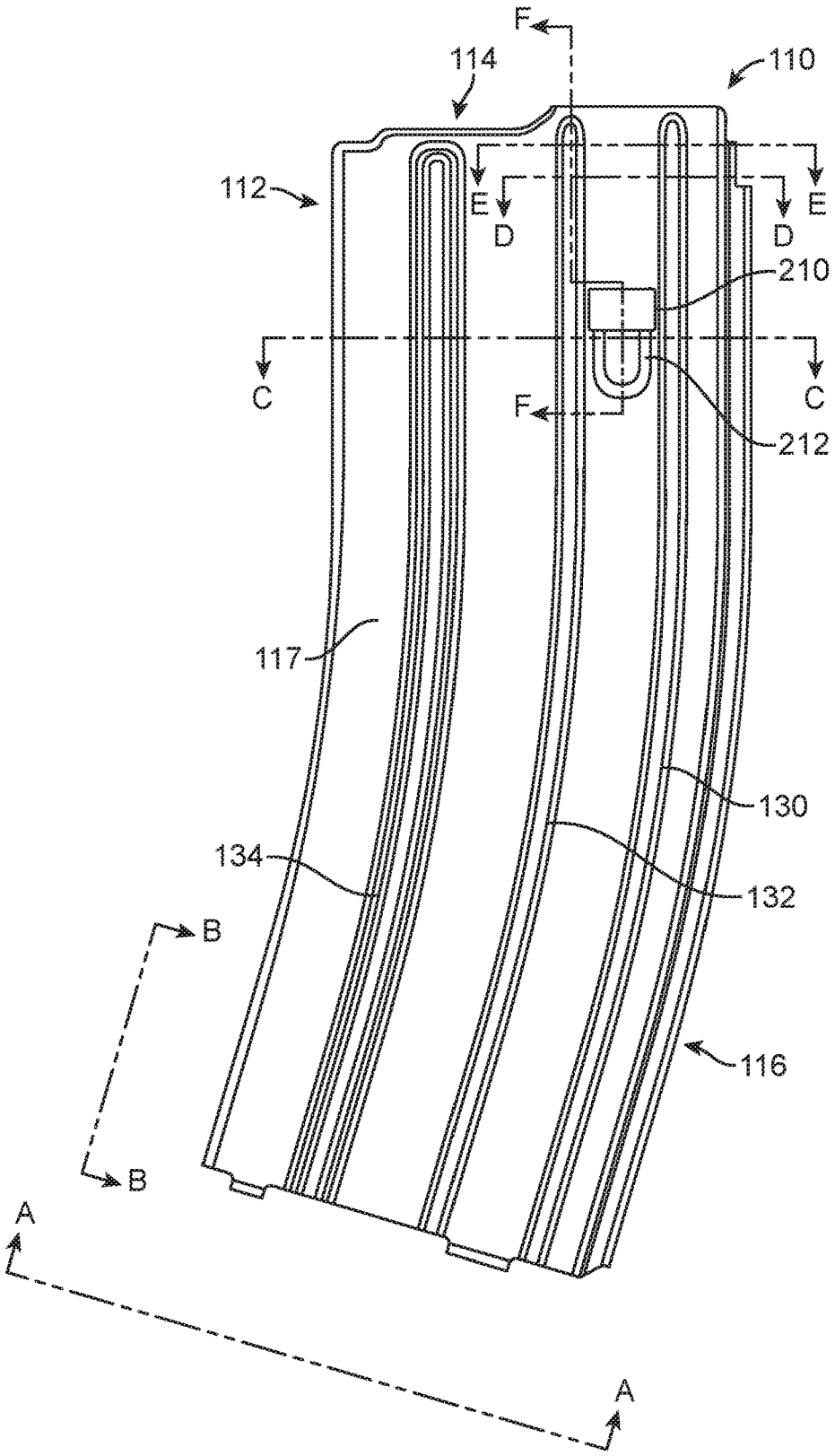
FIG. 2 is a side view of the multi-caliber AR magazine, in accordance with an embodiment of the present disclosure.

FIG. 2 is a side view of the multi-caliber AR magazine, in accordance with an embodiment of the present disclosure. This figure illustrates a view of the side 117 of the multi-caliber AR magazine 110. The front 112, top 114, and rear 116 are visible in this view, as well as the first rib 130 (of the first pair of ribs), third rib 132 (of the second pair of ribs) and fifth rib 134 (of the third pair of ribs). A latch interface 210 is provided which secures the magazine within the rifle, and a raised portion 212 also forms part of the latch interface to allow the magazine to latch securely within the rifle, in accordance with an embodiment. FIG. 2 also provides the directionality of arrows for cross-sections A-A shown in FIG. 5, C-C shown in FIG. 8, D-D shown in FIG. 9, E-E shown in FIG. 10 and F-F shown in FIG. 11.

Figure 3:
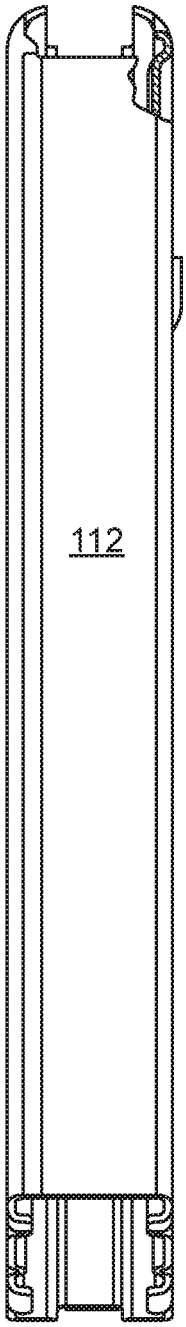
FIG. 3 is a front view of the multi-caliber AR magazine, in accordance with an embodiment of the present disclosure.
Figure 5:
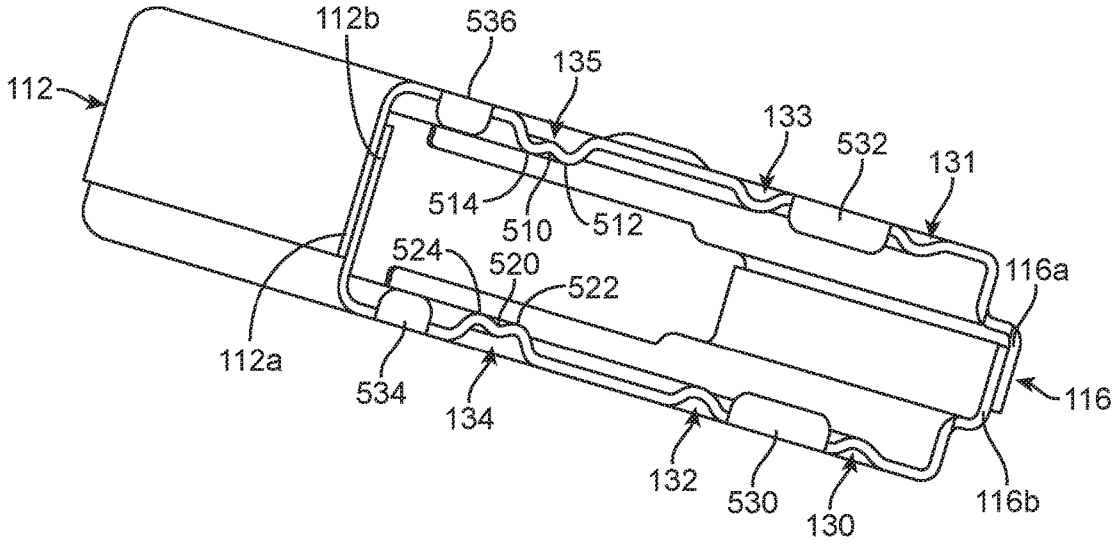
FIG. 5 is a bottom view of the multi-caliber AR magazine, as taken in cut-out along line A-A of FIG. 2, in accordance with an embodiment of the present disclosure.
Figure 7:
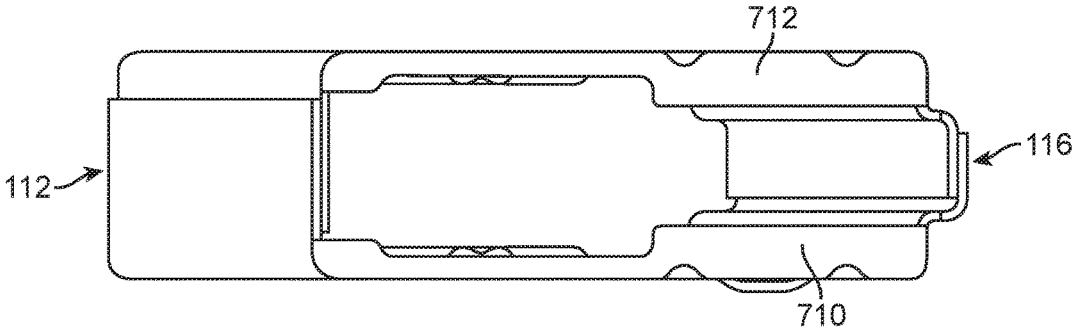
FIG. 7 is a top view of the multi-caliber AR magazine, in accordance with an embodiment of the present disclosure.

FIG. 3 is a front view of the multi-caliber AR magazine, in accordance with an embodiment of the present disclosure. The front surface 112 of the multi-caliber AR magazine 110 is shown as having a relatively flat surface, in accordance with an embodiment of the present disclosure. Although shown as being flat, the end may be folded over in some embodiments, or may be a flat end in other embodiments. Refer, for example, to FIG. 5 or FIG. 7, which show an example cross-section showing the front surface 112 in greater detail, in accordance with an embodiment of the present disclosure.

Figure 4:
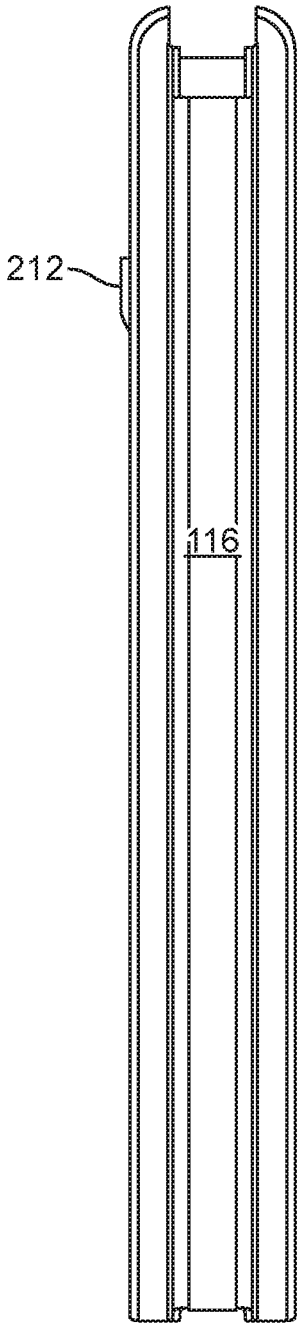
FIG. 4 is a rear view of the multi-caliber AR magazine, in accordance with an embodiment of the present disclosure.

FIG. 4 is a rear view of the multi-caliber AR magazine, in accordance with an embodiment of the present disclosure. The rear surface 116 of the multi-caliber AR magazine 110 is shown having a folded over surface, in accordance with an embodiment of the present disclosure. The surface 116 can be folded over as shown, or can have a thickened portion, or may be of uniform thickness in some embodiments. Refer, for example, to FIG. 5 or FIG. 7, which shows an example cross-section showing the rear surface 116 in greater detail, in accordance with an embodiment of the present disclosure.

FIG. 5 is a bottom view of the multi-caliber AR magazine, as taken in cut-out along line A-A of FIG. 2, in accordance with an embodiment of the present disclosure. The structure of the front 112 and the rear 116 are more clearly shown in FIG. 5, as well as the cross-section of the first pair of ribs 130, 131, second pair of ribs 132, 133, and third pair of ribs 134, 135. Also shown in this figure are four tabs 530, 532, 534, and 536, configured to receive a base plate (not shown) that secures a spring mechanism (also not shown) in place when inserted in the magazine, in accordance with an embodiment. The spring mechanism feeds the cartridges into the AR using the force of the spring, according to an embodiment of the present disclosure.

As shown, the front surface 112 includes a first portion 112*a* folded over a second portion 112*b*, which can be bonded together by an appropriate welding, crimping or other securing technique to achieve the structure shown. Other techniques for securing the folded over portions together, for example if sheet metal is used, include hardware assembly, spot welding, riveting, brazing, soldering, bonding with glue or another adhesive, or other techniques as will be appreciated. In some injection-molded embodiments, the front surface 112 may be uniform and omit the folding, as will be appreciated in light of the present disclosure. The rear surface 116 of the multi-caliber AR magazine also includes a first section 116*a* folded over a second section 116*b*, which can be bonded together by welding or another appropriate technique to achieve the structure shown, as will be appreciated in light of the present disclosure. In some injection-molded embodiments, the rear surface 116 may be of uniform thickness and the folding may be omitted.

As shown in FIG. 5, each of the third pair of ribs 134, 135 has been rebated, or otherwise pushed outwardly along a central portion of the rib after being initially indented inwardly. This results in the dual-curved structure (i.e. having two curves in a same direction) more clearly visible in FIG. 5. As shown, the sixth rib 135 defines a dual-curved rib having a central convex portion 510 connected between two concave portions 512, 514, and likewise the fifth rib 134 defines a dual-curved rib having a central convex portion 520 connected between two concave portions 522, 524. By rebating, or otherwise forming the dual-curved rib, the distance between two ribs is lengthened and each of the ribs 134 and 135 do not constantly contact the plurality of cartridges as they pass from a bottom of the housing toward a top of the housing. Note that the curves of the dual-curved rib are described as being "convex" or "concave" with respect to the magazine housing. Thus, the curves 512 and 514 are considered to be concave with respect to the surface 118 of the magazine housing, and the curve 510 is considered to be convex with respect to the surface 118 of the magazine housing, and likewise the curves 522, 524 are considered to be concave with respect to the surface 117 of the magazine housing and the curve 520 is considered to be convex with respect to the surface 117 of the magazine housing, as will be appreciated in light of the present disclosure.

Figure 6:
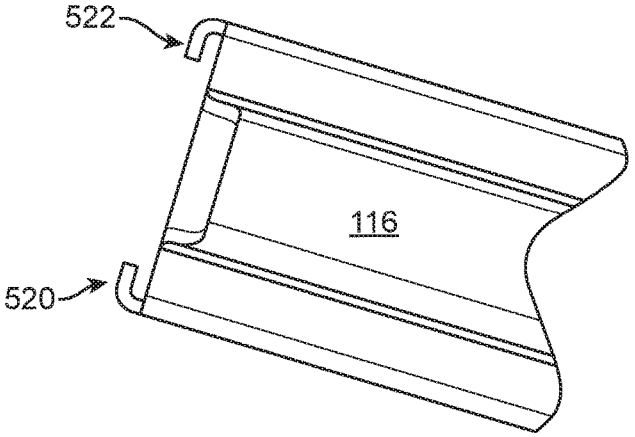
FIG. 6 is a partial rear view of the multi-caliber AR magazine, as taken along line B-B of FIG. 5, in accordance with an embodiment of the present disclosure.

FIG. 6 is a partial rear view of the multi-caliber AR magazine, as taken along line B-B of FIG. 5 in accordance with an embodiment of the present disclosure. As shown in FIG. 6, the tabs 530, 532 are shown extending below the rear 116 of the multi-caliber AR housing 110. The tabs 530, 532 are curved and allow a base plate (not shown) to be received and secured therein.

FIG. 7 is a top view of the multi-caliber AR magazine, in accordance with an embodiment of the present disclosure. The top (shown as 114 in FIG. 2) is shown as including curved extensions 710, 712 that are configured to provide an upward stop for the cartridges. The curved extensions 710, 712 also guide the cartridges as they are fed from the top of the magazine. The resulting cartridge path may, in some examples, be further refined. For example, the upper portion of the third pair of ribs can be formed such that the cartridge contacts the rib on one side or another, and is thereby deflected toward the center of the rifle's chamber. Note that each extension 710, 712 extends upward above the first pair of ribs and second pair of ribs, and curve inward toward a center of the housing.

Figure 8:
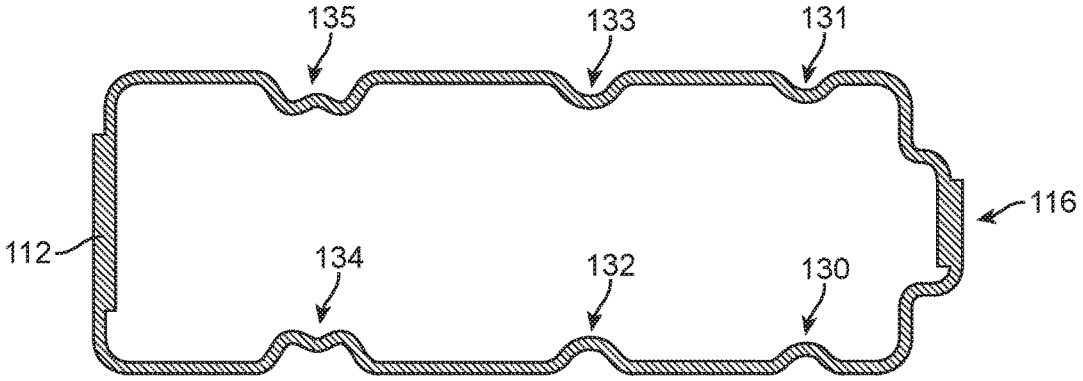
FIG. 8 is a cross-sectional view of the multi-caliber AR magazine, as taken along line C-C of FIG. 2, in accordance with an embodiment of the present disclosure.
Figure 9:
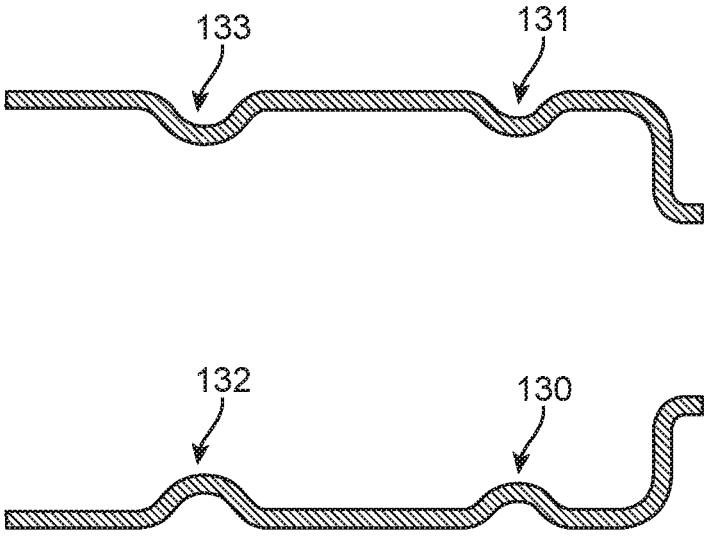
FIG. 9 is a cross-sectional view of the multi-caliber AR magazine, as taken along line D-D of FIG. 2, in accordance with an embodiment of the present disclosure.
Figure 10:
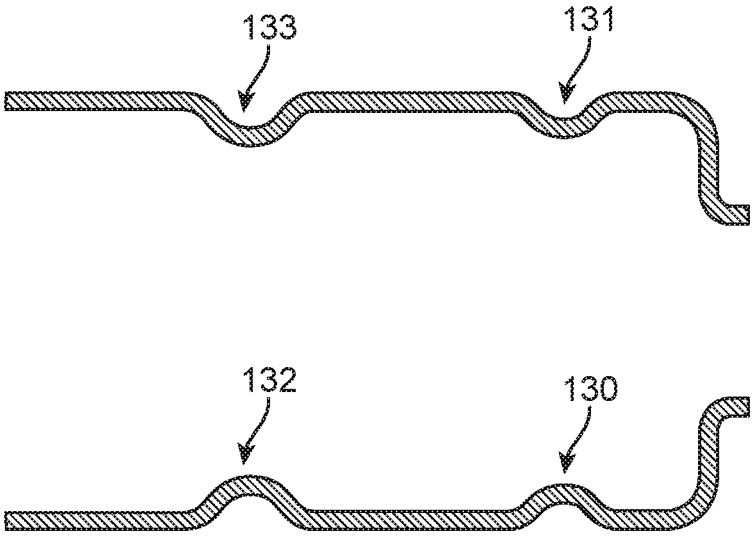
FIG. 10 is a cross-sectional view of the multi-caliber AR magazine, as taken along line E-E of FIG. 2, in accordance with an embodiment of the present disclosure.
Figure 12:
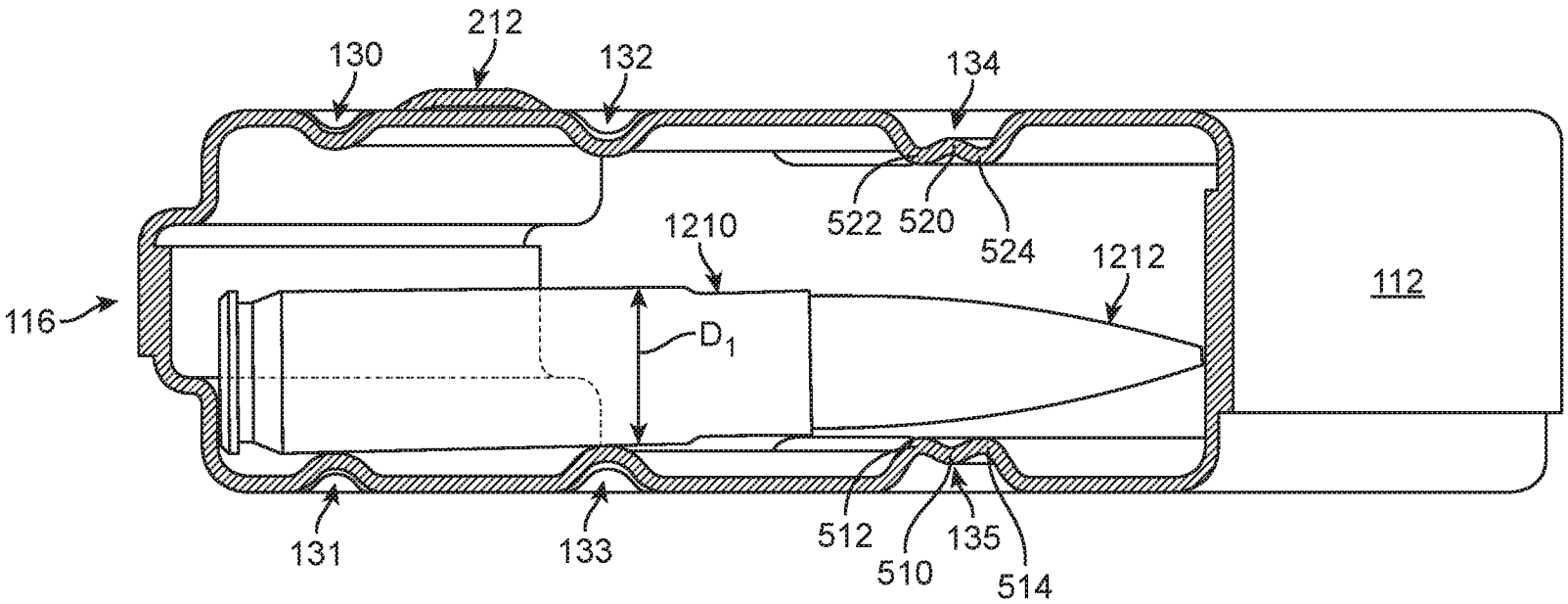
FIG. 12 is a cross-sectional view through a central portion of the multi-caliber AR magazine, showing a first cartridge having a first caliber supported by the multi-caliber AR magazine, in accordance with an embodiment of the present disclosure.
Figure 13:
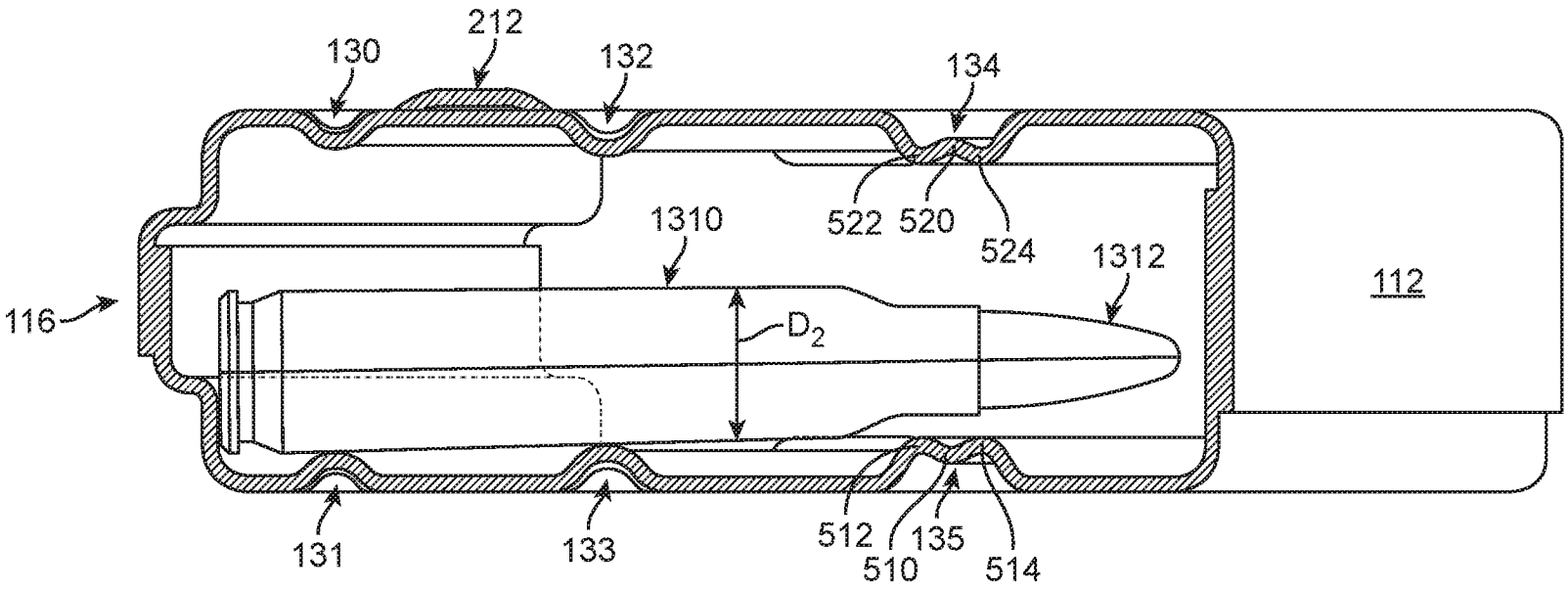
FIG. 13 is a cross-sectional view through a central portion of the multi-caliber AR magazine, showing a second cartridge having a second caliber supported by the multi-caliber AR magazine, in accordance with an embodiment of the present disclosure.

FIGS. 8-10 illustrate various cross-sectional views as taken through the multi-caliber AG magazine of FIG. 2. FIG. 8 is a cross-sectional view of the multi-caliber AR magazine, as taken along line C-C of FIG. 2, FIG. 9 is a cross-sectional view of the multi-caliber AR magazine, as taken along line D-D of FIG. 2, and FIG. 10 is a cross-sectional view of the multi-caliber AR magazine, as taken along line E-E of FIG. 2, in accordance with an embodiment of the present disclosure. It will be appreciated in light of the present disclosure that the second pair of ribs 132, 133 is indented further in toward a center of the multi-caliber AR magazine 110 than the first pair of ribs 130, 131. As a result, the distance between ribs 132 and 133 is less than the distance between ribs 130 and 131. This difference may be carried throughout the length of the magazine or may be in certain portions of the magazine including one or more of the lower third, the middle third and the upper third of the magazine housing. The second pair of ribs 132, 133 are indented further than the first pair of ribs 130, 131 to account for the tapering of the body of the cartridge, for example as shown in detail in FIGS. 12 and 13, showing two different caliber cartridges that can alternately be supported by the multi-caliber AR magazine 110. In the cross-sectional view C-C of FIG. 2, shown in FIG. 8, the indentation of rib 132 is less than the indentation of rib 132 in the cross-section D-D shown in FIG. 9, and the indentation of rib 132 in E-E shown in FIG. 10 is less than the indentation of rib 132 shown in Figure D-D, in accordance with an example embodiment of the present disclosure. This means that the distance separating ribs 132 and 133 can decrease from C-C up to E-E as shown in FIG. 2. In different embodiments, view line C-C can be, for example, 1.0 inch, 1.5 inch or 2.0 inch from the upper surface of the magazine. Similarly, view line E-E can be less than half an inch or less than a quarter inch from the top of the magazine.

Figure 11:
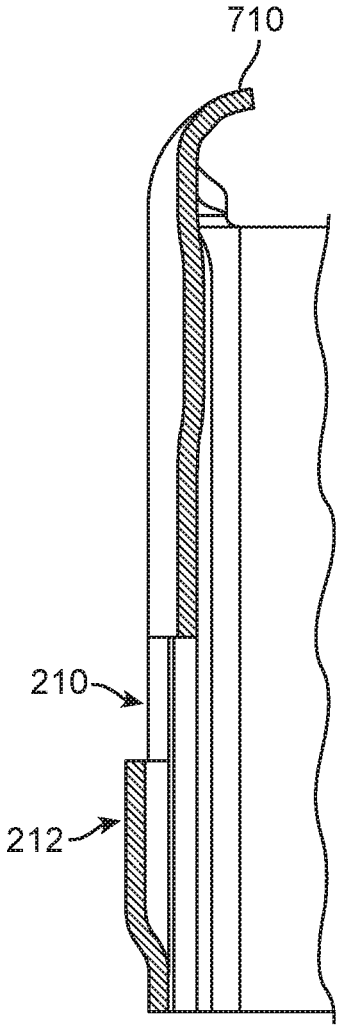
FIG. 11 is a cross-sectional view of the multi-caliber AR magazine, as taken along line F-F of FIG. 2, in accordance with an embodiment of the present disclosure.

FIG. 11 is a cross-sectional view of the multi-caliber AR magazine, as taken along line F-F of FIG. 2, in accordance with an embodiment of the present disclosure. The latch interface 210 and raised portion 212 are visible in this cross-section, as well as the upward curved extension 710.

Reference is now made to FIGS. 12 and 13, showing a cross-sectional view through a central portion of the multi-caliber AR magazine, with different caliber cartridges that can alternately be loaded in the multi-caliber AR magazine, according to an embodiment of the present disclosure. FIG. 12 shows a first cartridge having a first caliber supported by the multi-caliber AR magazine, and FIG. 13 shows a second cartridge having a second caliber different from the first caliber supported by the multi-caliber AR magazine, in accordance with an embodiment of the present disclosure. In accordance with an embodiment of the present disclosure, the first cartridge shown in FIG. 12 can be a 300 caliber cartridge which can for example be the commercially available 300 Blackout, and the second cartridge shown in FIG. 13 can be a 556 caliber cartridge which can for example be the commercially available 556 NATO, and they can both be, alternately, supported by the same multi-caliber AR magazine. It will be appreciated in light of the present disclosure that other caliber cartridges can be supported by a multi-caliber AR magazine where the cartridges have a common feature, such as a common cartridge body diameter, or another common feature.

With reference to FIG. 12, the first pair of ribs 130, 131, the second pair of ribs 132, 133, and the third pair of ribs 134, 135 is shown. It is visible in FIG. 12 that the second pair of ribs are indented toward a center of the housing more than the first pair of ribs such that a first distance between the third rib and the fourth rib is less than a second distance between the first rib and the second rib. The first pair of ribs 130, 131 and the second pair of ribs 132, 133 are indented inwardly toward a center of the housing 110 such that the second rib 131 and the fourth rib 133 both contact the body 1210 of the cartridge, even though the diameter of the cartridge at each point of contact is different. Note that the second rib 131 is located proximate the head of the cartridge 1210 and the fourth rib 133 is closer to the projectile 1212 but does not contact the projectile.

With reference to FIG. 13, the first pair of ribs 130, 131, the second pair of ribs 132, 133, and the third pair of ribs 134, 135 is shown. The first pair of ribs 130, 131 and the second pair of ribs 132, 133 is indented in toward a center of the housing 110 such that the second rib 131 and the fourth rib 133 both contact the body 1310 of the cartridge, which supports the bullet 1312. It will be appreciated in light of the present disclosure that both caliber cartridges can be supported by the magazine as long as the diameter D1 and the diameter D2 are approximately equal. Note that the diameter of each of the compatible cartridges can vary greatly (greater than 10%) at the position of the third pair of ribs 134, 135.

In a caliber-specific (non-multi-caliber) magazine, commonly referred to as a mil-spec magazine, each magazine is specifically designed for a particular cartridge. One example of a caliber-specific magazine includes three pairs of vertical ribs that are placed on a side surface of the housing in similar positions as the ribs of the multi-caliber AR magazine. Another example of a caliber-specific magazine includes two pairs of vertical ribs, with a first pair being positioned at the rear of the magazine to contact the proximal end of the cartridge, and a second pair being positioned at the front or in a central portion of the magazine to contact the projectile of the cartridge. In such an example, there may be only one contact point between the first pair of ribs and the body of the cartridge. In the caliber-specific magazine, it is the first pair of ribs that contact the projectile and the third pair of ribs (on opposite ends of the magazine near the front and the rear of the housing) that contact the cartridge to secure it within the magazine. Such a caliber-specific magazine structure, for example in the 556 NATO cartridges (shown in FIG. 12), support the stack of loaded cartridges between a first pair of ribs at the rear of the cartridge body and another pair of ribs forward at the cartridge neck. If one were to attempt to insert the 300 Blackout cartridge (shown in FIG. 13) in the same caliber-specific magazine, instead of contacting at the neck, the shorter 300 Blackout cartridge would engage the forward pair of ribs with highly-variable bullet ogive, which can disrupt the alignment of the cartridge in the magazine and result in unreliable feeding.

By providing the multi-caliber AR magazine housing structure in accordance with the present disclosure, the housing supports the body of the cartridges (e.g., 1210 in FIGS. 12 and 1310 in FIG. 13) in two locations to secure cartridges having a common diameter, meaning that the diameter of the cartridge case is approximately equal for both cartridges, such that D1 in FIG. 12 is approximately the same diameter as D2 in FIG. 13. In this manner, cartridges having approximately the same diameter and differing overall lengths or another different feature, can still achieve reliable feeding. As shown, a rib from the first pair (e.g. rib 130 or 131) and a rib from the second pair (e.g. rib 132 or 133) each simultaneously contact the shell casing of the cartridge. The diameter D1 of the cartridge case 1210 and the diameter D2 of the cartridge case 1310 are approximately equal, allowing the structure of the multi-caliber AR magazine to allow for varying calibers and loads to be supported by the multi-caliber AR magazine, by relying on the similar diameters of the cartridge cases. Note that although D1 and D2 are shown at specific locations along the body of the cartridge, it will be appreciated that the diameter of the body is tapered so that it is greatest at the rear of the body, and shortest at the front of the body that supports the bullet. Thus, when referring to the diameter, it is intended that the tapered diameter is approximately the same for the cartridge case 1210 and 1230. The rib 133 supports the body near the shoulder of the shorter 300 Blackout cartridge case. This preserves the successful cartridge alignment first established by the mil-spec design, regardless of whether the 556 NATO or 300 Blackout cartridge is supported by the magazine. Thus, although bullet ogive may vary considerably, reliable feeding with either cartridge is achieved, as will be appreciated in light of the present disclosure.

In accordance with an embodiment of the present disclosure, each of the ribs can contact the casing at one or more single points of contact or an elongated rib projection can contact the body along a contact region that forms a continuous contact. A single point of contact can have, for example, a width of the rib contacting the body of the cartridge that is 1 millimeter (mm) or less, 5 mm or less, or 10 mm or less. In some instances, the single point of contact can include a larger width, for example, of up to 50 mm of the surface of the rib that is in contact with the cartridge when the cartridge is received in the magazine housing. One or more of the single point of contact ribs can be replaced with an elongated inward projection, having a region of contact (or "contact region") that is generally greater than the contact afforded by the individual ribs and provides a continuous contact region. It will be appreciated in light of the present disclosure that a rib has a single point of contact with the cartridge when received in the magazine housing, which can have a varying width of a few millimeters to up to dozens or hundreds of millimeters. It will also be appreciated in light of the present disclosure that an elongated inward projection is essentially a rib that has a region of contact which, for example, can be one-quarter or one-half the length of the body of the cartridge to securely retain the cartridge in the magazine housing. For example, a cartridge having a body length of 50 mm, then the region of contact would be approximately 10-15 mm for a semi-elongated inward projection, and approximately 20-30 mm for an elongated inward projection.

Figure 15:
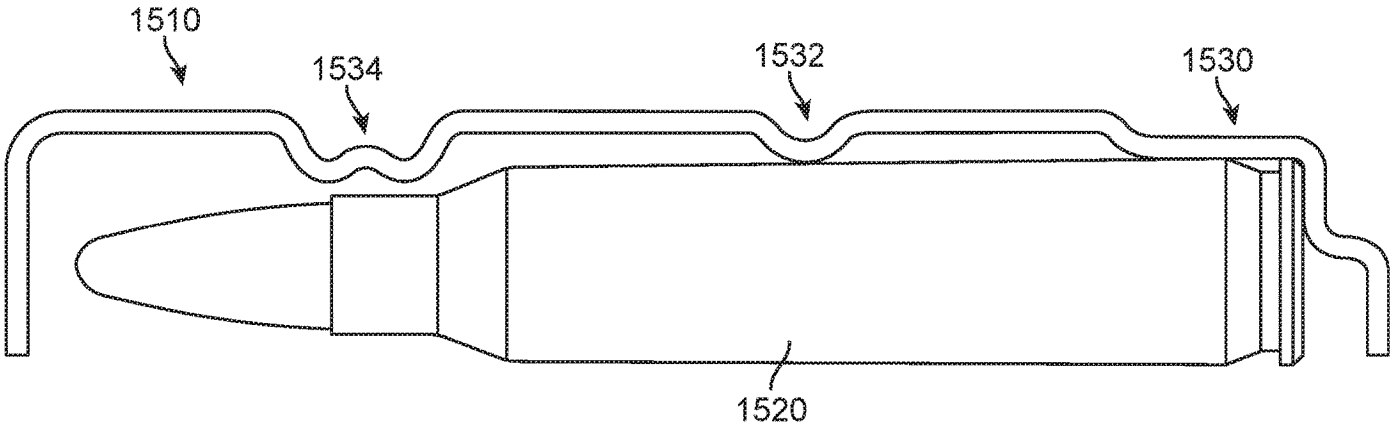
FIG. 15 is a cross-sectional view through a central portion of a multi-caliber AR magazine, where a third pair of ribs is replaced with an inward projection, showing one semi-elongated inward projection and two ribs, in accordance with an embodiment of the present disclosure.

In some embodiments, rather than a first rib that contacts a single point of the body, the first rib can be replaced with a first inward projection that can contact a region of the body of the cartridge. FIG. 15 is a cross-sectional view through half of a central portion of a multi-caliber AR magazine, where a first pair of ribs replaced with a semi-elongated inward projection, showing one semi-elongated inward projection and two ribs, in accordance with an embodiment of the present disclosure. As shown, the magazine 1510 includes a first inward projection 1530 that supports a cartridge 1520. The inward projection 1530 provides a contact region for the body 1520 that is approximately equal to one-quarter or one-half of the length of the body of the cartridge. The magazine 1510 also includes a second rib 1532 for securing the body of the cartridge 1520 within the magazine 1510. A fifth rib 1534 of a third pair of ribs is rebated to provide clearance for the cartridges as they move through the magazine 1510.

Figure 16:
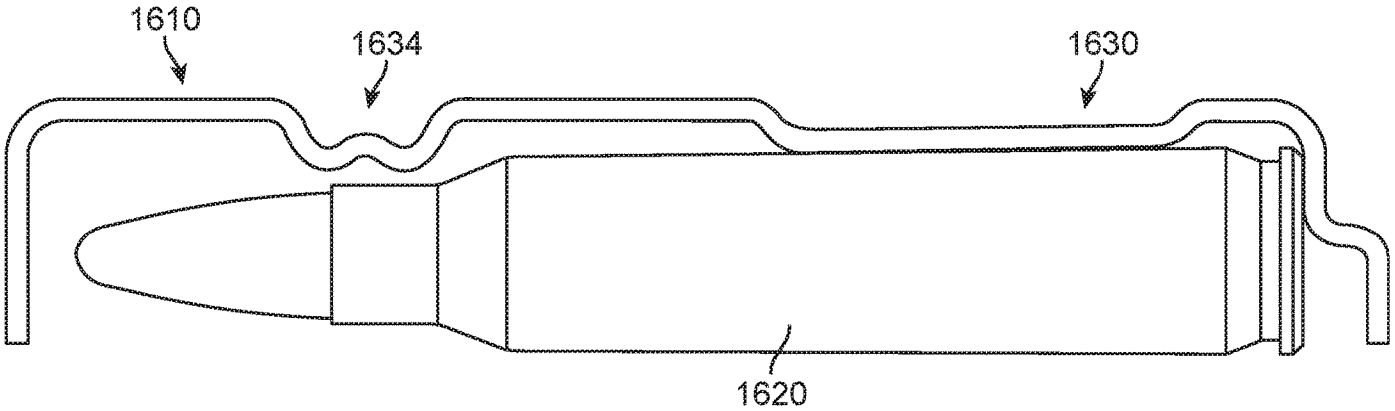
FIG. 16 is a cross-sectional view through a central portion of a multi-caliber AR magazine, where a second and third pair of ribs is replaced with an inward projection, showing one elongated inward projection and one other rib, in accordance with an embodiment of the present disclosure.

Note that in some embodiments, rather than a first rib that contacts the body of the cartridge and a second rib that contacts the body of the cartridge, a continuously constricted portion of the magazine wall can form an elongated inward projection that replaces the function of two ribs (for example, ribs 130 and 132 in FIGS. 1-12). As shown in FIG. 16, the elongated inward projection 1630 can be a planar portion that extends, for example, the same distance as two ribs. FIG. 16 is a cross-sectional view through a central portion of half of a multi-caliber AR magazine, showing first and third ribs replaced with an inward projection, in accordance with an embodiment of the present disclosure. As shown, the magazine 1610 includes a first inward projection 1630 that supports a cartridge 162. The inward projection 1630 provides a contact region for the body 1620 that is approximately equal to one-half of the length of the body 1620 of the cartridge. The magazine 1610 also includes a second rib 1634 that is rebated to provide clearance for the cartridges as they move through the magazine 1610. In the example magazine 1610 of FIG. 16, the elongated inward projection structure 1630 may be in the form of a ramp that inclines inwardly from the rear of the magazine toward a central portion of the magazine, mirroring the profile of the cartridges 1620 to be loaded. The elongated inward projection structure 1630 may be about as long as the distance between the first and second pair of ribs. The elongated inward projection structure tapers consistently with the taper of the body of the cartridge to securely hold the cartridge in place within the magazine. Accordingly, in such an embodiment, the elongated projection may contact the body of the cartridge at two or more points along a length of the body of the cartridge, specifically the cartridge shell, to securely retain the cartridge in place. In such embodiments, a first model cartridge may contact the inward projection structure at two points and a second model cartridge may contact the inward projection structure at one or two different points than the first model cartridge. In other cases, the inward projection structure may retain contact with the cartridge at three or more points, or securely along the entire length of the cartridge 1620 that is in contact with the projection 1630. Note that less material is used to form a continuously constricted portion than is used in forming two ribs. Thus in cases where forming two ribs from a blank would shorten the magazine too much, a continuously constricted portion may be preferable.

It will be appreciated in light of the present disclosure that rebating the third pair of ribs further enhances the structure of the magazine. The rebating provides a dual-curved rib structure that is stronger and reduces flex when compared to a single indentation that forms a single curve. Thus, the overall stiffness of the magazine is further enhanced by the dual-curved structure of the third pair of ribs, versus the single curve of a caliber-specific magazine, as will be appreciated in light of the present disclosure. Rebating the third pair of ribs allows the cartridges to clear the magazine while still serving to stiffen the body of the magazine. In some embodiments, the third pair of ribs can be configured to contact and guide an uppermost cartridge as it is expelled from the magazine during feeding.

In some embodiments, rather than rebating the third pair of ribs, the third pair of ribs can be creased. In such an embodiment, the width of the second pair of ribs can be narrowed, such that the same length of sheet stock is consumed in production as in a corresponding caliber-specific magazine. For example, where available sheet metal is used to manufacture the multi-caliber AR magazine, and available sheet metal toolings that are intended for a caliber-specific magazine design are also used, these same sheet metal and toolings can be used to provide the multi-caliber AR structure disclosed herein, even though the cross section of the magazines will have significant differences. For example, by creasing the third pair of ribs, a similar amount of sheet metal material is able to be consumed, without having the third pair of ribs extends out to and interfere with the ogive of the bullet, and thus a similar or identical stamped sheet can be used. An advantage of the design according to some embodiments the present disclosure is that the same amount of sheet metal material can be used as with a caliber-specific design, without having the third set of ribs contact the cartridges in the housing.

Figure 14:
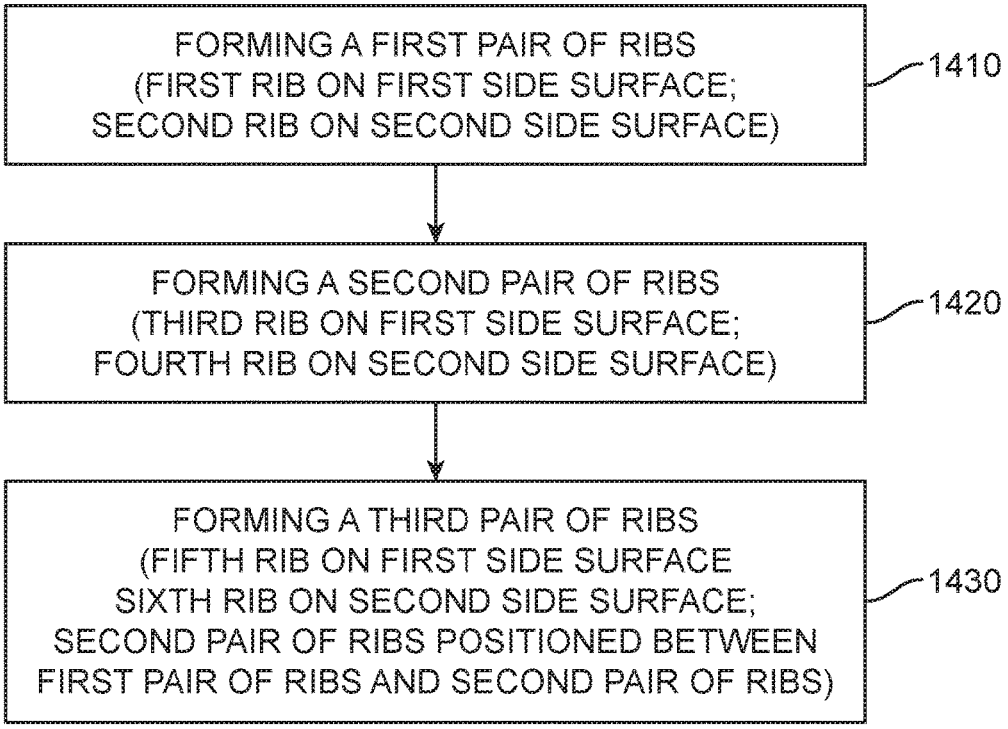
FIG. 14 is an example methodology for forming the multi-caliber AR magazine, in accordance with an embodiment of the present disclosure.

FIG. 14 is an example methodology for forming the multi-caliber AR magazine, in accordance with an embodiment of the present disclosure. The method can be performed by a sheet metal stamp or die or other appropriate tooling, or can be an injection-molded process, as will be appreciated in light of the present disclosure. The order shown in FIG. 14 is only one example order and can be changed, rearranged, added to, or otherwise modified, in accordance with an example embodiment of the present disclosure. For example, the order in which the ribs are formed may be that all three pairs of ribs are formed simultaneously, or in some embodiments each rib or each pair of ribs may be individually formed, depending upon the type of manufacturing that is selected to achieve the multi-caliber AR magazine structure in accordance with an embodiment of the present disclosure. In a one-piece magazine body design using sheet metal, the overall shape of the magazine is formed after the ribs are formed on the sheet metal. In a two-piece design, the ribs can be formed simultaneously, or in any appropriate sequence, and then the two pieces can be welded closed or welded together, as will be appreciated. In an injection-molded polymer embodiment, a single molding operation can be used to create the shape including the ribs. Where both metal and polymer material is used, the ribs can be found in elements of either or both materials, as will be appreciated.

The method includes forming 1410 a first pair of ribs, in accordance with an embodiment of the present disclosure. The first pair of ribs includes a first rib on a first side surface and a second rib on a second side surface, which can for example be the first rib 130 on surface 117 and the second rib 131 on the second surface 118, in accordance with an embodiment of the present disclosure.

The method includes forming 1420 a second pair of ribs, in accordance with an embodiment of the present disclosure. The second pair of ribs includes a third rib on the first side surface and a fourth rib on the second side surface, which can for example be the third rib 132 on the side surface 117 and the fourth rib 133 on the side surface 118, in accordance with an embodiment of the present disclosure. It will be appreciated in light of the present disclosure that in some embodiments, the second pair or ribs may be omitted, or may be (together with the first pair of ribs) replaced with an elongated projection formed according to the techniques of the present disclosure.

The method includes forming 1430 a third pair of ribs, in accordance with an embodiment of the present disclosure. The third pair of ribs includes a fifth rib on a first side surface and a sixth rib on the second side surface, which can for example be the fifth rib 134 on the side surface 117 and the sixth rib 135 on the side surface 118, in accordance with an embodiment of the present disclosure. The second pair of ribs can be positioned between the first pair of ribs and the third pair of ribs, as will be appreciated in light of the present disclosure.

Numerous embodiments will be apparent in light of this disclosure. The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A multi-caliber magazine for a firearm configured to support a plurality of cartridges, the multi-caliber magazine comprising:

a housing having a front, a rear, a first sidewall extending vertically between the front and the rear, and a second sidewall extending vertically between the front and the rear;

a first pair of ribs including a first rib extending vertically along the first sidewall, and a second rib extending vertically along the second sidewall, the first pair of ribs positioned proximate the rear of the housing; and a second pair of ribs including a third rib extending vertically along the first sidewall, and a fourth rib extending vertically along the second sidewall, wherein a first distance between the third rib and the fourth rib is less than a second distance between the first rib and the second rib;

wherein each of the third rib and the fourth rib has a pair of inward protrusions extending into the housing and a portion extending outward, the portion extending outward located between the pair of inward protrusions, wherein the portion extending outward and the pair of inward protrusions are positioned inward relative to the respective first sidewall or second sidewall.

2. The multi-caliber magazine of claim 1, further comprising a third pair of ribs including a fifth rib extending vertically along the first sidewall, and a sixth rib extending vertically along the second sidewall, wherein the second pair of ribs is positioned proximate the front of the housing, and wherein the third pair of ribs are positioned between the first pair of ribs and the second pair of ribs.

3. The multi-caliber magazine of claim 1, wherein the second pair of ribs is positioned adjacent projectiles or necks of the plurality of cartridges when the plurality of cartridges are installed in the multi-caliber magazine, and wherein at least one rib of the second pair of ribs is constructed to provide clearance between each of the second pair of ribs and the projectiles and necks of the plurality of cartridges when the plurality of cartridges are installed in the multi-caliber magazine.

4. The multi-caliber magazine of claim 1, wherein each of the pair of inward protrusions and the portion extending outward has an arcuate shape.

5. The multi-caliber magazine of claim 1, wherein at least an upper portion of the second pair of ribs extends sufficiently inwardly to contact a top-most cartridge of the plurality of cartridges when the plurality of cartridges are installed in the multi-caliber magazine.

6. The multi-caliber magazine of claim 2, wherein the first rib and the fifth rib are positioned to simultaneously contact a case of at least some of the cartridges when the plurality of cartridges are loaded in the multi-caliber magazine.

7. The multi-caliber magazine of claim 1, wherein a portion of the third rib and a portion of the fourth rib each define a creased surface.

8. The multi-caliber magazine of claim 1, wherein the housing is configured to support both a first caliber cartridge and a second caliber cartridge, the first caliber different from the second caliber.

9. The multi-caliber magazine of claim 1, wherein the housing is configured to functionally support both 7.62×35 mm cartridges and 5.56×45 mm cartridges.

10. The multi-caliber magazine of claim 1, wherein the housing is formed of a stamped sheet metal material.

11. The multi-caliber magazine of claim 1, wherein the housing is formed of an injection-molded polymer.

12. The multi-caliber magazine of claim 2, wherein one rib of the first pair of ribs and one rib of the third pair of ribs are constructed and arranged to simultaneously contact at least one of the plurality of cartridges when the multi-caliber magazine is full.

13. A method of forming a multi-caliber automatic rifle (AR) magazine from a housing having a front, a rear, a first sidewall extending vertically between the front and the rear, and a second sidewall extending vertically between the front and the rear, the multi-caliber AR magazine configured to support cartridges of a plurality of calibers, the method comprising:

forming a first pair of ribs on the housing, the first pair of ribs including a first rib extending vertically along the first sidewall of the housing and a second rib extending vertically along the second sidewall of the housing, the first pair of ribs positioned proximate the rear of the housing; and forming a second pair of ribs on the housing, the second pair of ribs including a third rib extending vertically along the first sidewall of the housing and a fourth rib extending vertically along the second sidewall of the housing, the second pair of ribs being indented toward a center of the housing more than the first pair of rib;

wherein each of the third rib and the fourth rib has a pair of inward protrusions extending into the housing and a portion extending outward, the portion extending outward located between the pair of inward protrusions, wherein the portion extending outward and the pair of inward protrusions are positioned inward relative to the respective first sidewall or second sidewall.

14. The method of claim 13, further comprising: forming a third pair of ribs on the housing, the third pair of ribs including a fifth rib extending vertically along the first sidewall, and a sixth rib extending vertically along the second sidewall, wherein the second pair of ribs is formed proximate the front of the housing, wherein the third pair of ribs are formed between the first pair of ribs and the second pair of ribs.

15. The method of claim 13, wherein the housing is a sheet metal material, and wherein forming the first pair of ribs and forming the second pair of ribs is performed by stamping the sheet metal material of the housing.

16. The method of claim 13, wherein forming the first pair of ribs and forming the second pair of ribs is performed by injection-molding a polymer.

17. The method of claim 14, further comprising: raising a central portion of the fifth rib and the sixth rib to each define a dual-curved rib with a central convex portion connected between two concave portions.

18. A multi-caliber magazine for a firearm configured to support a plurality of cartridges, the multi-caliber magazine comprising:

a housing having a front, a rear, a first side extending vertically between the front and the rear, and a second side extending vertically between the front and the rear;

a first pair of ribs including a first rib extending vertically along a first side, and a second rib extending vertically along a second side, the first pair of ribs positioned proximate the front of the housing and configured to provide clearance for projectiles of the plurality of the cartridges when the plurality of cartridges are installed in the multi-caliber magazine; and a second pair of ribs including a third rib extending vertically along the first side, and a fourth rib extending vertically along the second side, the second pair of ribs positioned proximate the rear of the housing, the second pair of ribs configured to contact a body portion of the plurality of cartridges at a first point of contact when the plurality of cartridges are installed in the multi-caliber magazine;

wherein each of the first pair of ribs has a pair of inward protrusions extending into the housing and a portion extending outward, the portion extending outward located between the pair of inward protrusions, wherein the portion extending outward and the pair of inward protrusions are positioned inward of the respective first side or second side.

19. The multi-caliber magazine of claim 18, further comprising:

a third pair of ribs positioned between the first pair of ribs and the second pair of ribs, the third pair of ribs including a fifth rib extending vertically along the first side, and a sixth rib extending vertically along the second side, wherein a first distance between the fifth rib and the sixth rib is less than a second distance between the third rib and the fourth rib.

20. The multi-caliber magazine of claim 19, wherein the third pair of ribs are configured to contact the body portion of the plurality of cartridges at a second point of contact.

21. The multi-caliber magazine of claim 18, wherein the third rib of the second pair of ribs defines a first elongated inward projection having a horizontal length approximately equal to at least half of a length of the body portion of one of the plurality of cartridges, and the fourth rib of the second pair of ribs defines a second elongated inward projection having the horizontal length approximately equal to at least half of the length of the body portion.

22. The multi-caliber magazine of claim 18, wherein the second pair of ribs define an elongated inward projection having a horizontal length that is approximately equal to at least a quarter of a length of the body portion of one of the plurality of cartridges, the elongated inward projection configured to provide a continuous contact region with the body portion.

23. The multi-caliber magazine of claim 22, further comprising a third pair of ribs positioned between the first pair of ribs and the second pair of ribs, wherein the third pair of ribs each define a single point of contact with the body portion of the plurality of cartridges, to thereby provide both a single point of contact with the body portion by the third pair of ribs and a continuous contact region with the body portion by the elongated inward projection of the second pair of ribs.

* * * * *